US005399187A

United States Patent [19]

Mravic et al.

[11] Patent Number: 5,399,187

[45] Date of Patent: Mar. 21, 1995

[54] LEAD-FREE BULLETT

[75] Inventors: Brian Mravic, North Haven; Deepak Mahulikar, Madison; Gerald N. Violette, New Haven; Eugene Shapiro, Hamden, all of Conn.; Henry J. Halverson, Collinsville, Ill.

[73] Assignee: Olin Corporation, New Haven, Conn.

[21] Appl. No.: 125,946

[22] Filed: Sep. 23, 1993

[51] Int. Cl.[6] ..... F42B 1/00; F42B 8/14

[52] U.S. Cl. ..... 75/228; 102/445; 102/459; 102/506; 102/514; 102/517; 102/448; 75/230; 75/248

[58] Field of Search ..... 102/445, 448, 459, 506, 102/514, 517; 75/228, 230, 248

[56] References Cited

U.S. PATENT DOCUMENTS

| | | | |
|---|---|---|---|
| 2,105,526 | 1/1938 | Foisy | 102/26 |
| 2,409,307 | 10/1946 | Patch et al. | 102/92.5 |
| 2,442,155 | 5/1948 | Weese | 102/92.5 |
| 2,995,090 | 8/1961 | Daubenspeck | 102/91 |
| 3,123,003 | 3/1964 | Lange, Jr. et al. | 102/91 |
| 3,363,561 | 1/1968 | Irons | 102/42 |
| 3,898,933 | 8/1975 | Castera et al. | 102/92.7 |
| 3,946,673 | 3/1976 | Hayes | 102/52 |
| 4,005,660 | 2/1977 | Pichard | 102/92.1 |
| 4,027,594 | 6/1977 | Olin et al. | 102/92.4 |
| 4,428,295 | 1/1984 | Urs | 102/448 |
| 4,603,637 | 8/1986 | Snide et al. | 102/529 |
| 4,850,278 | 7/1989 | Dinkha et al. | 102/501 |
| 4,881,465 | 11/1989 | Hooper et al. | 102/501 |
| 4,939,996 | 7/1990 | Dinkha et al. | 102/501 |
| 4,949,644 | 8/1990 | Brown | 102/498 |
| 4,949,645 | 8/1990 | Hayward et al. | 102/517 |
| 4,958,572 | 9/1990 | Martel | 102/529 |
| 5,088,415 | 2/1992 | Huffman et al. | 102/515 |

*Primary Examiner*—Donald P. Walsh
*Assistant Examiner*—Daniel Jenkins
*Attorney, Agent, or Firm*—Gregory S. Rosenblatt

[57] ABSTRACT

A composite lead-free bullet is disclosed comprising a heavy constituents selected from the group of tungsten, tungsten carbide, carballoy, and ferro-tungsten and a second binder constituent consisting of either a metal alloy or a plastic blend.

8 Claims, 5 Drawing Sheets

LEAD-FREE BULLETT

CROSS-REFERENCE TO RELATED APPLICATIONS

This is an original application.

BACKGROUND OF THE INVENTION

FIELD OF INVENTION

This invention relates generally to projectiles and more particularly to a projectile which is lead free.

DESCRIPTION OF THE RELATED ART

Lead projectiles and lead shots which are expended in indoor ranges are said by some medical experts to pose a significant health hazard. Ingestion by birds, particularly water fowl, has been said to pose a problem in the wild. In indoor shooting ranges, lead vapors due to vaporized lead from lead bullets is of concern. Disposal of the lead-contaminated sand used in in sand traps in conjunction with the backstops in indoor ranges is also expensive, since lead is a hazardous material. Reclamation of the lead from the sand is an operation which is not economically feasible for most target ranges.

Accordingly, various attempts have been made to produce effective lead-free bullets.

Density differences between bullets of the same size, find using the same power charges result in differences in long range trajectory and differences in firearm recoil. Such differences are undesirable as the shooter needs to have a trajectory consistent with that of a lead bullet so the shooter knows where to aim and a recoil consistent with that of shooting a lead bullet so the "feel" of shooting is the same as that of shooting a lead bullet. If these differences in trajectory and recoil are large enough, experience gained on the practice range will degrade, rather than improve, accuracy when firing a lead bullet in the field.

Various approaches have also been used to produce shot pellets that are non toxic. U.S. Pat. Nos. 4,027,594 and 4,428,295 assigned to the assignee of the present invention, disclose such non-toxic shot. Both of these patents disclose pellets made of metal powders wherein one of the powders is lead. U.S. Pat. Nos. 2,995,090 and 3,193,003 disclose gallery bullets made of iron powder, a small amount of lead powder, and a thermoset resin. Both of these bullets are said to disintegrate upon target impact. The main drawback of these bullets is their density, which is significantly less than that of a lead bullet. Although, these are not entirely lead free, the composition of the shot or bullets is designed to reduce the effects of the lead. U.S. Pat. No. 4,881,465 discloses a shot pellet made of lead and ferro-tungsten, which is also not lead free. U.S. Pat. Nos. 4,850,278 and 4,939,996 disclose a projectile made of ceramic zirconium which also has a reduced density compared to lead. U.S. Pat. No. 4,005,660 discloses another approach, namely a polyethylene matrix which is filled with a metal powder such as bismuth, tantalum, nickel, and copper. Yet another known approach is a frangible projectile made of a polymeric material which is filled with metal or metal oxide. U.S. Pat. No. 4,949,644 discloses a non toxic shot which is made of of bismuth or a bismuth alloy. However, bismuth is in such short supply that it is of limited utility for projectiles. U.S. Pat. No. 5,088,415 discloses a plastic covered lead shot. However, as with other examples discussed above, this shot material still contains lead, which upon backstop impact, will be exposed to the environment. Plated lead bullets and plastic-coated lead bullets are also in use, but they have the same drawback that upon target impact the lead is exposed and this creates spent bullet disposal difficulties.

Need for New Approach

None of the prior bullets noted above has proved commercially viable, either due to cost, density differences, difficulty of mass production and the like. Accordingly, a new approach is needed to obtain a projectile for target shooting ranges or for hunting use which is completely devoid of lead and performs ballistically similarly to lead.

SUMMARY OF THE INVENTION

The invention described in detail below is basically a lead-free bullet which comprises a solid body comprising a sintered composite having one or more, high-density constituent powder materials selected from the group consisting of tungsten carbide, tungsten, ferrotungsten and carballoy, and a second, lower-density constituent consisting essentially either of a metallic matrix material selected from the group of consisting of tin, zinc, iron and copper, or a plastic matrix material selected from the group consisting of phenolics, epoxies, dialylphthalates, acrylics, polystyrenes, polyethylene, or polyurethanes. In addition, the composite of either type may contain a filler metal such as iron powder or zinc powder. The bullet of the invention comprises a solid body having a density of at least about 9 grams per cubic centimeter (80 percent that of pure lead), and a yield strength in compression greater than about 4500 p.s.i.

Other constituents could also be added in small amounts for special purposes such as enhancing frangibility. For example, carbon could be added if iron is used as one of the composite components to result in a brittle or frangible microstructure after suitable heat treatment processes. Lubricants and/or solvents could also be added to the metal matrix components to enhance powder flow properties, compaction properties, ease die release etc.

The invention stems from the understanding that ferrotungsten and the other high-density, tungsten-containing materials listed are not only economically feasible for bullets, but that they can, by an especially thorough metallurgical and ballistic analysis, be alloyed in proper amounts under proper conditions to become useful as lead free bullets.

The invention further stems from the realization that ballistic performance can best be measured by actual shooting experiences since the extremes of acceleration, pressure, temperature, frictional forces, centrifugal acceleration and deceleration forces, impact forces both axially and laterally, and performance against barriers typical of bullet stops in current usage impose an extremely complex set of requirements on a bullet that make accurate theoretical prediction virtually impossible.

BRIEF DESCRIPTION OF DRAWINGS

The invention will be better understood by referring to the attached drawing, in which.

DETAILED DESCRIPTION OF THE INVENTION

Figure 1:
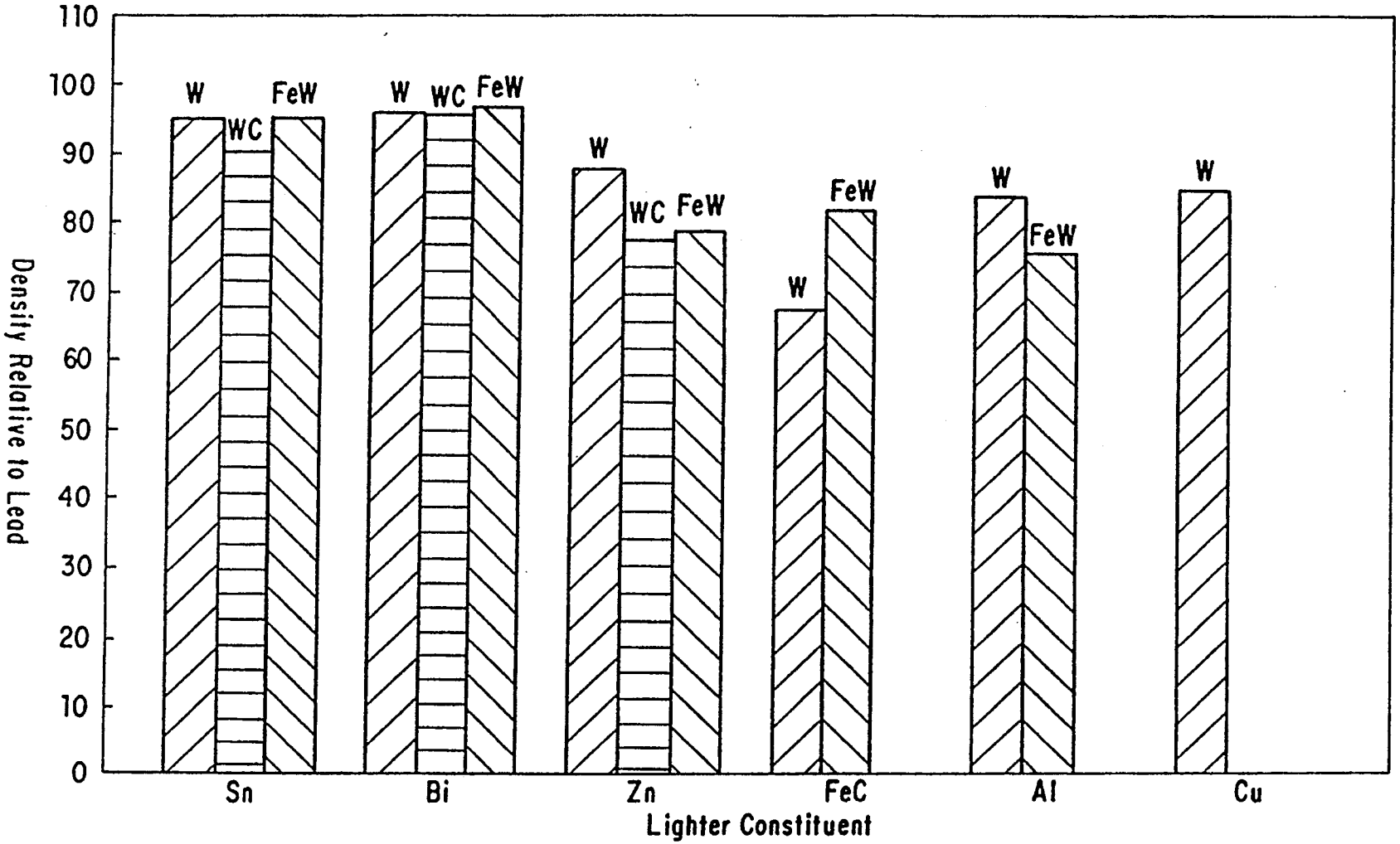
FIG.1 is a bar graph of densities of powder composites.

Basic Description and The Six Basic Requirements

The Six Requirements

There are at least six (6) requirements for a successful lead-free bullet. First, the bullet must closely approximate the recoil of a lead bullet when fired so that the shooter feels as though he is firing a standard lead bullet. Second, the bullet must closely approximate the trajectory, i.e. exterior ballistics, of a lead bullet of the same caliber and weight so that the practice shooting is directly relevant to shooting in the field with an actual lead bullet. Third, the bullet must not penetrate or damage the normal steel plate backstop on the target range and must not ricochet significantly. Fourth, the bullet must remain intact during its travel through the gun barrel and while in flight. Fifth, the bullet must not damage the gun barrel. Sixth, the cost of the bullet must be reasonably comparable to other alternatives. Requirements 1 and 2 (Recoil and Flight Like Lead)

In order to meet the first two requirements, the lead-free bullet must have approximately the same density as lead. This means that the bullet must have an overall density of about 11.3 grams per cubic centimeter.

Requirement 3 (Minimum Bullet Trap Damage)

The third requirement above, that of not penetrating or damaging the normal steel backstops at target shooting ranges, dictates that the bullet must either (1) deform at stresses lower than those which would be sufficient to penetrate or severely damage the backstop, or (2) fracture into small pieces at low stresses or (3) both deform and fracture at low stress.

As an example, a typical 158 grain lead (0.0226 lb.) .38. Special bullet has a muzzle kinetic energy from a four inch barrel of 200 foot pounds (2,400 inch pounds) and a density of 0.41 pounds per cubic inch. This corresponds to an energy density of 43,600 inch-pounds per cubic inch. The deformable lead-free bullet in accordance with the invention must absorb enough of this energy per unit volume as strain energy (elastic plus plastic) without imposing on the backstop stresses higher than the yield strength of mild steel (about 45,000 psi) in order for the bullet to stop without penetrating or severely damaging the target backstop. In the case of a frangible bullet or a deformable frangible bullet respectively, the fracture stress of the bullet must be below the stresses experienced by the bullet upon impact with the target backstop and below the yield strength of mild steel.

Requirements 4 and 5 (Remain Intact and Not Erode Barrel)

The requirements that the bullet remain intact as it passes through the barrel and that the bullet not cause excessive barrel erosion, are more difficult to quantify. Actual shooting tests are normally required to determine this quality. However, it is clear that the bullet of the invention must be coated with metal or plastic or jacketed in a conventional manner to protect the barrel.

Requirement 6 (Reasonable Cost)

The cost of ferrotungsten is generally reasonable in comparison to other high-density alternatives, as are the costs of each of the alternatives noted in the claims below.

3.2. Basic Methods of The Invention

The metal-matrix bullets in accordance with the preferred embodiments of the present invention would be fabricated by powder metallurgical techniques.

Methods for Frangible Materials

For the more frangible materials, the powders of the individual constituents would be blended, compacted under pressure to near net shape, and sintered in that shape. If the bullets are jacketed, compacting could be done in the jacket and sintered therein. Alternatively, the bullets could be compacted and sintered before being inserted into the jackets. If the bullets are coated, they would be coated after compacting and sintering. The proportions of the several powders would be those required by the rule of mixtures to provide a final density about equal to that of lead. In this formulation, the inability to eliminate all porosity must be taken into account and compensated for by an appropriate increase in the proportion of the denser constituent, tungsten, ferro-tungsten, carballoy, or tungsten carbide or mixtures thereof. The optimum mixture is determined by the tradeoff between raw material cost and bullet performance.

Methods For Ductile Materials

For the more ductile matrix materials such as the metals mentioned above, the bullets may be made by the above process or alternatively, compacted into rod or billet shapes using conventional pressing or isostatic pressing techniques. After sintering, the rod or billet could then be extruded into wire for fabrication into bullets by forging using punches and dies as is done with conventional lead bullets. Alternatively, if the materials are too brittle for such fabrication, conventional fabrication processes could be used to finish the bullet.

Frangibility Control Methods

Heat Treatment

The metal matrix bullets could be given an optional embrittling treatment to enhance frangibility after final shape forming. For example, an iron matrix bullet having a carbon addition could be embrittled by suitable heat treatment.

Alpha Tin Transformation

A tin matrix bullet could be embrittled by cooling it into and holding it within a temperature range in which partial transformation to alpha tin occurs. This method can provide precise control of the degree of frangibility.

Impurity Additions

A third example of embrittlement would be the use of select impurity additions such as bismuth to a copper matrix composite. After fabrication, the bullet could be heated to a temperature range in which the impurity collects preferentially at the copper grain boundaries, thereby embrittling them.

Sintering Time/Temperature

In addition, even without embrittling additives, frangibility can be controlled by suitably varying the sintering time and/or sintering temperature.

Methods Using Plastic Matrixes

A. Thermoplastic or Thermosetting Plastic

In the case of the thermoplastic or thermosetting plastic matrix materials, the powders are to be blended as described above using the same considerations as to mass and density and the mixture then directly formed into the final part by any of the conventional processes used in the field of polymer technology such as injection molding, transfer molding, etc.

B. Jacketed Plastic Matrixes

In the case of jacketed plastic-matrix bullets, compacting under heat can be done with the composite powder inside the jacket. Alternatively, the powders can be compacted using pressure and heat to form pellets for use in such processes.

Methods of Preventing Gun Barrel Erosion

Finally, in order to protect the gun barrel from damage during firing, the bullet must be jacketed or coated with a soft metallic coating or plastic coating. The coatings for the metal- matrix bullets would preferably be tin, zinc, copper, brass or plastic. In the case of plastic matrix bullets, plastic coatings would be preferred and it would be most desirable if the plastic matrix and coating could be of the same material. In both cases, plastic coatings could be applied by dipping, spraying, fluidized bed or other conventional plastic coating processes. The metallic coatings could be applied by electroplating, hot dipping or other conventional coating processes.

EXAMPLES

A. Plastic Matrix

Frangible plastic matrix composite bullets were made of tungsten powder with an average particle size of 6 microns. Iron powder was added to the tungsten powder at levels of 0, 15, and 30 percent by weight. After blending with one of two polymer powders, phenyl formaldehyde (Lucite) or polymethylmethalcrylate (Bakelite) which acted as the matrix, the mixtures were hot compacted at a temperature within the range of from about 300° to about 350° .F and a pressure of about 35–40 ksi into 1.25 inch diameter cylinders which were then cut into rectangular parallelepipeds for compression testing and drop weight testing. In all, six (6) samples were made: (#1) Lucite-Tungsten; (#2) Lucite-85% Tungsten-15% Iron; (#3) Lucite-70% Tungsten-30% Iron; (#4) Bakelite-Tungsten; (#5) Bakelite-85% Tungsten-15% Iron; (#6) Bakelite-70% Tungsten-30% Iron. The bullet materials so formed were very frangible in the compression test. Their behavior in the drop weight test was similarly highly frangible. The densities relative to that of lead for these samples (#1) 81%; (#2) 78%; (#3) 75%; (#4) 84%; (#5) 80%; (#6) 78%. The maximum stress in the compression test was (in ksi) (#1) 4.3; (#2) 3.4; (#3) 2.7; (#4) 4.7; (#5) 1.4; (#6) 1.9. The energy absorbed in the compression test for these materials was (in inch-pounds per in$^3$) (#1) 49; (#2) 40; (#3) 21; (#4) 40; (#5) 10; (#6) 9. The maximum stress before fracture was below 5 ksi which is well within the desired range to avoid backstop damage.

Metal Matrix Composites

FIG. 1 shows the densities attained with metal matrix composites made of tungsten powder, tungsten carbide powder or ferro-tungsten powder blended with powder of either tin, bismuth, zinc, iron (with 3% carbon), aluminum, or copper. The proportions were such that they would have the density of lead if there was no porosity after sintering. The powders were cold compacted into half-inch diameter cylinders using pressures of 100 ksi. They were then sintered for two hours at appropriate temperatures, having been sealed in stainless steel bags. The sintering temperatures were (in degrees Celsius) 180, 251, 350, 900, 565, 900 respectively.

Figure 2:
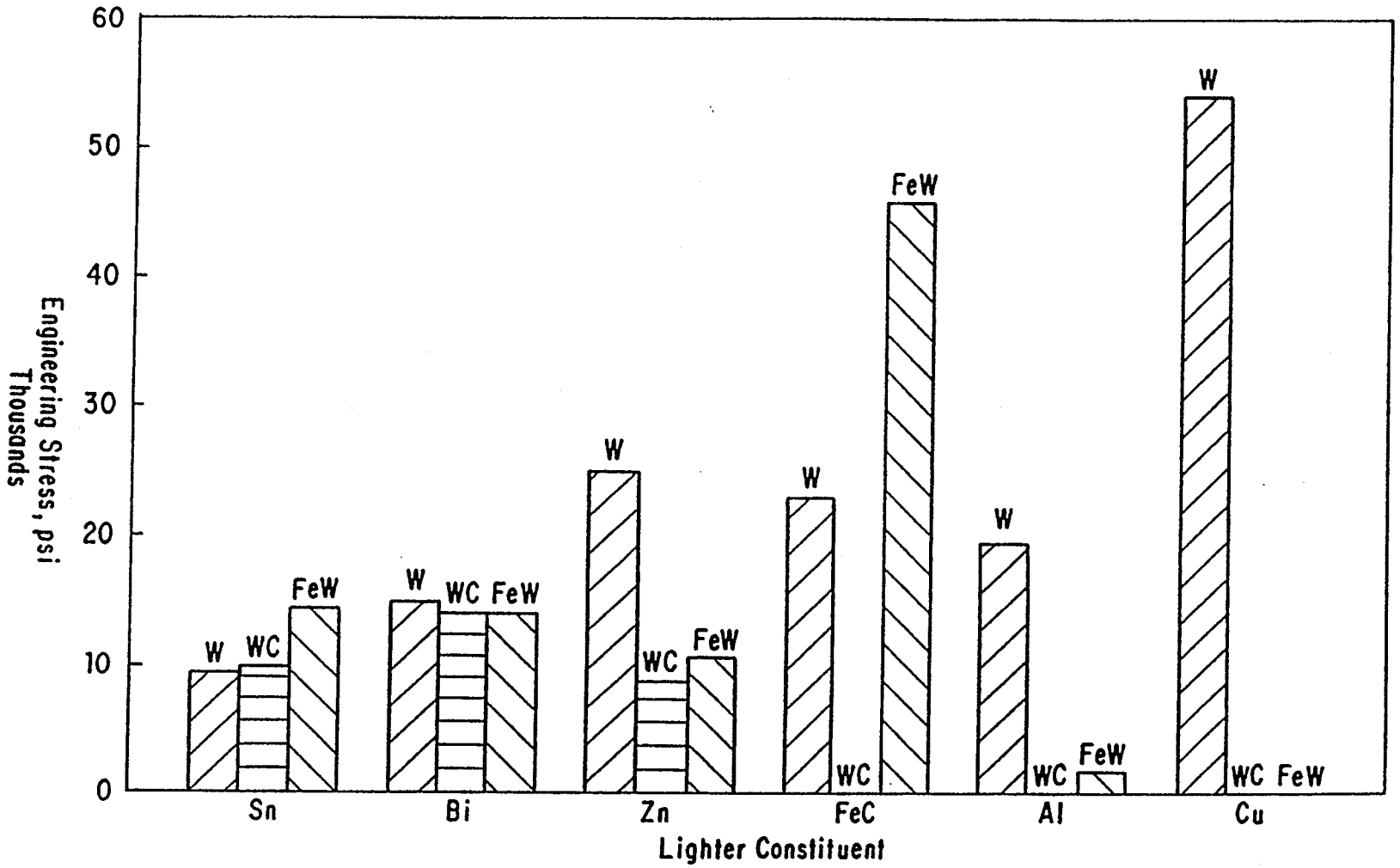
FIG. 2 is a bar graph of maximum engineering stress attained with the powder composites.
Figure 3:
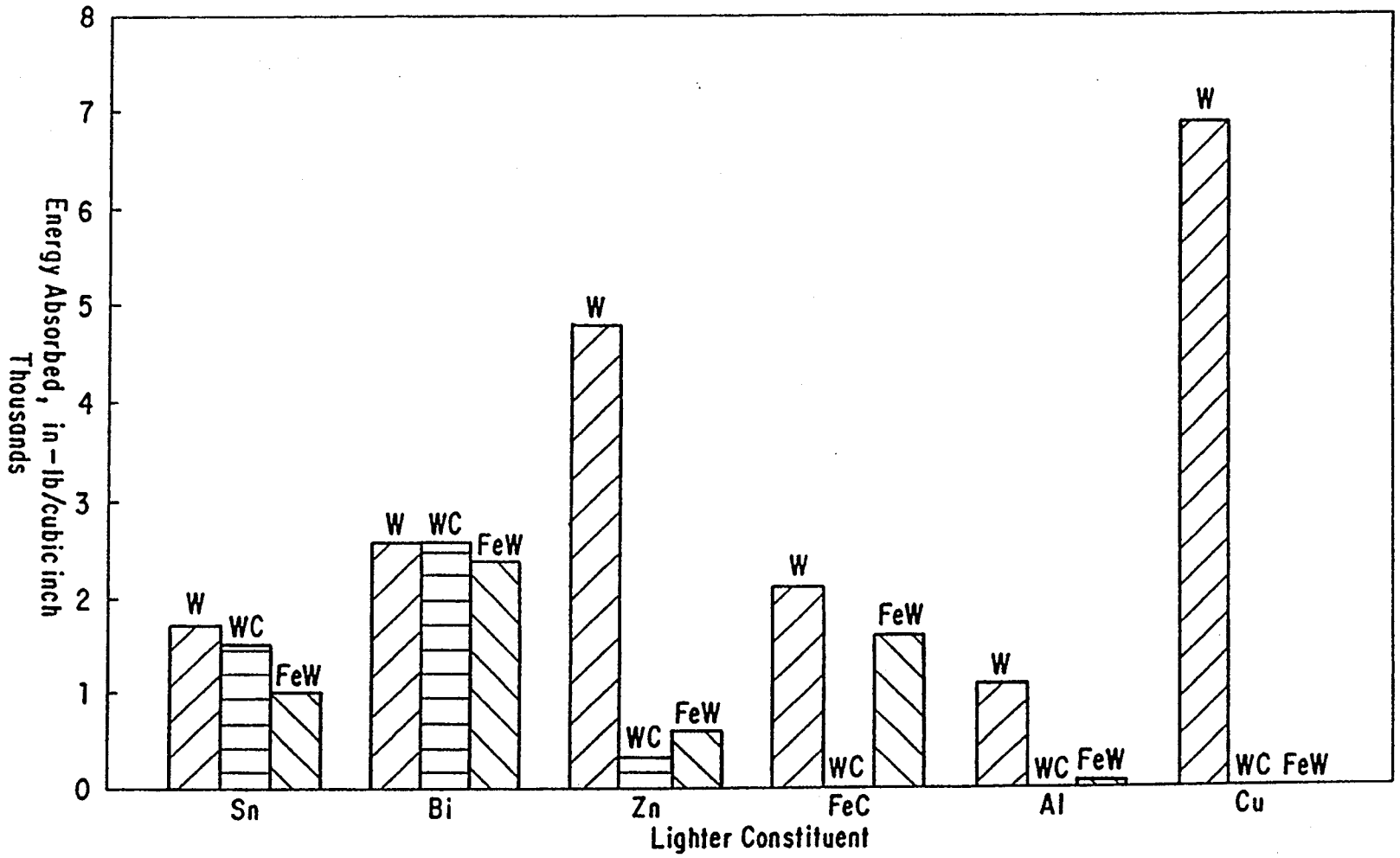
FIG. 3 is a bar graph of the total energy absorbed by the sample during deformation to 20% strain or fracture.

FIG. 2 shows the maximum axial internal stresses attained in the compression test. FIG. 3 shows the energies absorbed up to 20 percent total strain (except for the copper tungsten compact which reached such high internal stresses that the test was stopped before 20 percent strain was achieved). All of the materials exhibited some plastic deformation. The energy adsorptions in the compression test indicate the relative ductilities, with the more energy absorbing materials being the most ductile.

Even the most ductile samples such as the tin and bismuth matrix composites showed some fracturing during the compression test due to barreling and secondary tensile stresses which result from this. In the drop weight test using either 240 foot pounds or 120 foot pounds, the behavior was similar to but an exaggeration of that observed in the compression test.

Control Examples

Figure 4:
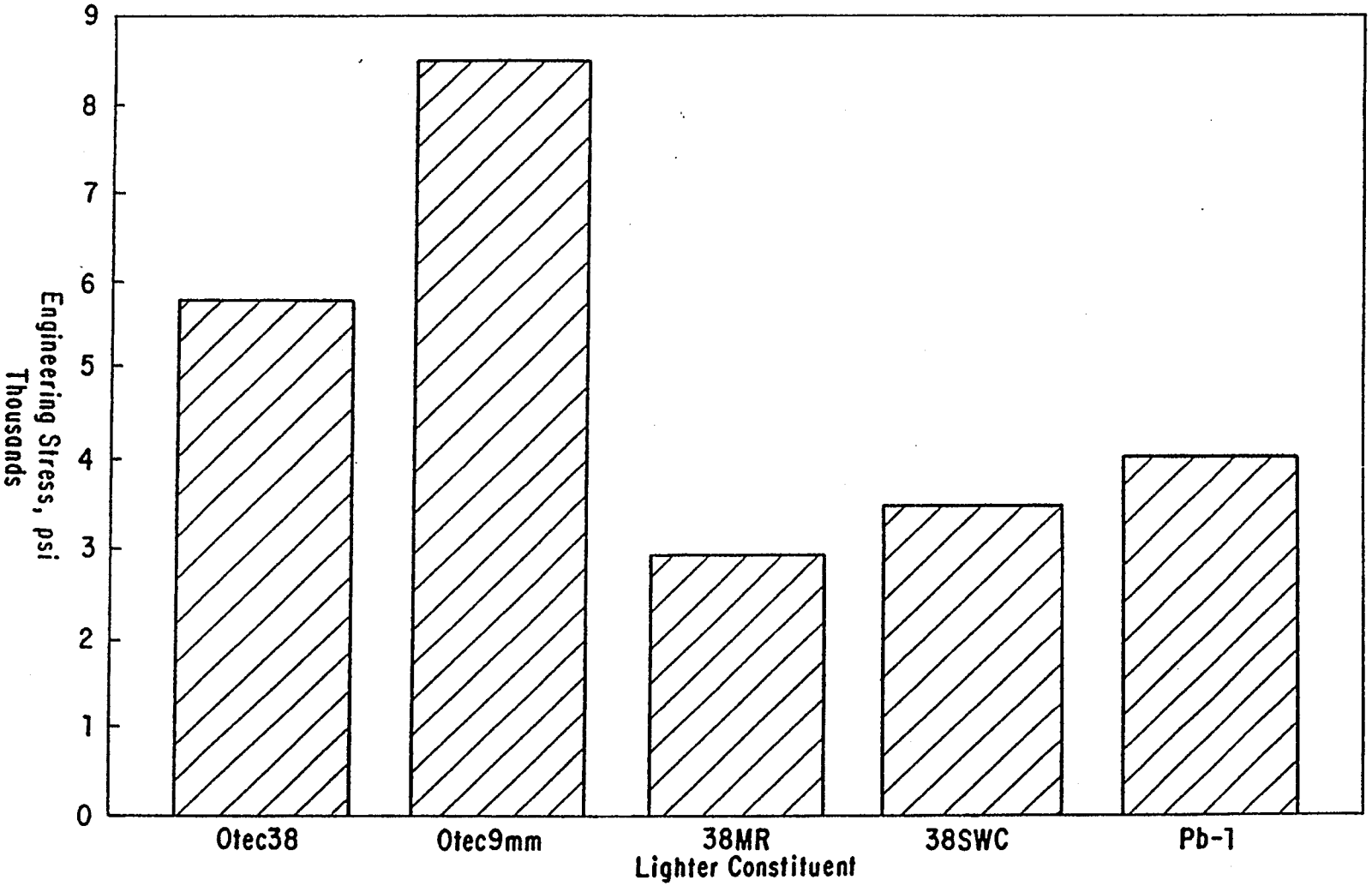
FIG. 4 is a bar graph showing the maximum stress at 20% deformation (or maximum) of 5 conventional bullets.
Figure 5:
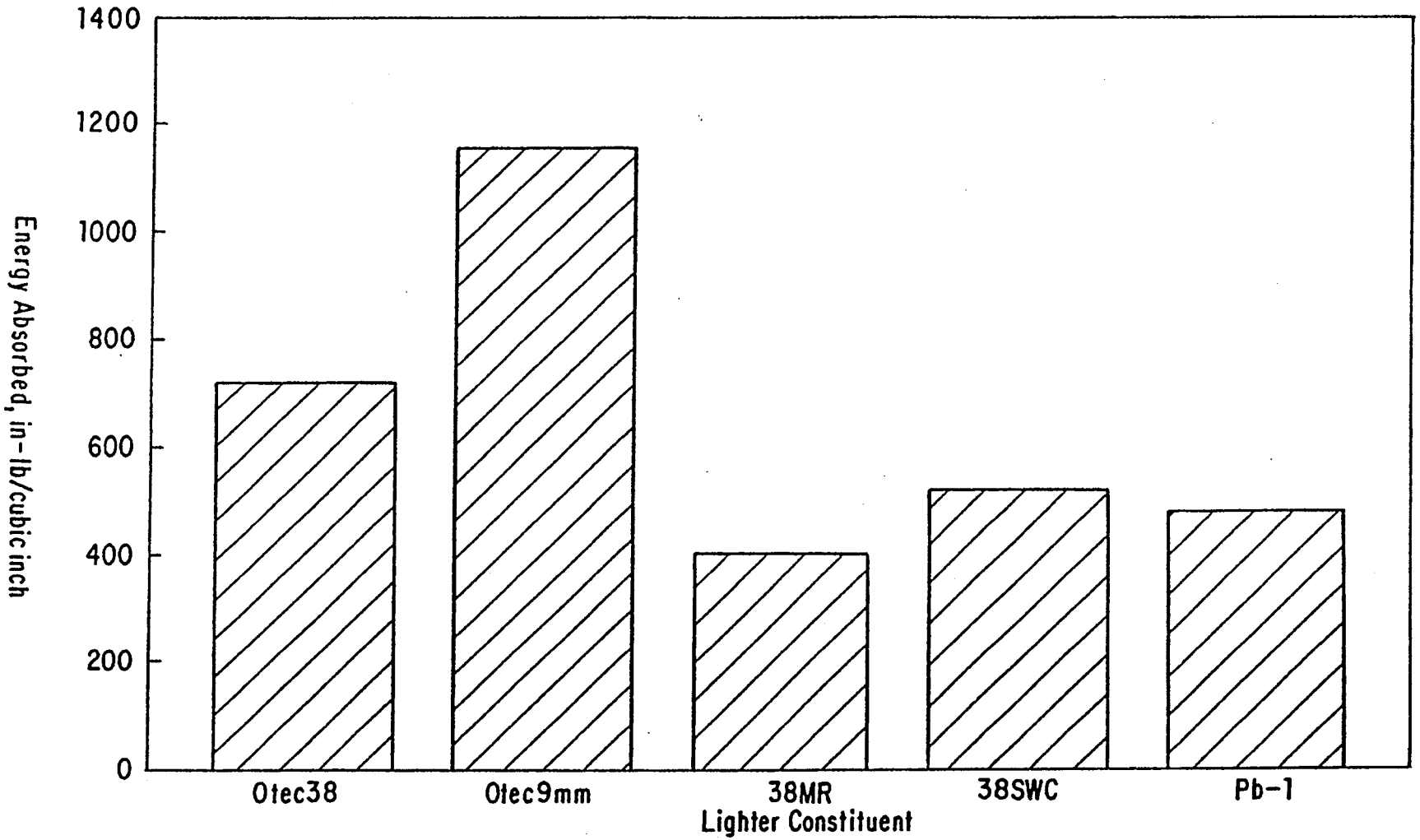
FIG. 5 is a bar graph showing the total energy absorbed in 20% deformation or fracture of the five conventional bullets of FIG. 4.

FIG. 4 shows, for comparison, a lead slug, two standard 38 caliber bullets, and two commercial plastic matrix composite bullets tested in compression. Figure 4 shows that maximum stresses of the lead slug and lead bullets were significantly less than those of the plastic bullets. However, all were of the same order as those attained by the metal matrix samples in the iron free plastic matrix samples. FIG. 5 shows the energy absorption for these materials. Values are generally less than that of the metal matrix samples shown in FIG. 3 and much higher than that of the frangible plastic matrix samples.

All of these materials deformed significantly in the 240 ft.-lb. drop weight test. The lead samples did not fracture, whereas the plastic matrix bullets did.

Jacketed Composite Bullets

As another example, 38 caliber metal-matrix bullets and plastic-matrix bullets with the compositions listed in Table I were fabricated inside standard brass jackets (deep-drawn cups) which had a wall thickness varying from 0.010 inches to 0.025 inches. The plastic-matrix ("Lucite" or "Bakelite" listed as code 1 and code 2 in the Table) )samples were compacted at the temperature described in the first example. The metal-matrix samples (Codes 3–11) were compacted at room temperature and sintered as described above while they were encased in the jackets.

TABLE I

| Code | Matrix | Bullets Used in Trial (all Jacketed except #4) Ferrotungsten in core wt. % | Density (with jacket), % vs. Pb | Average Weight, grains |
|---|---|---|---|---|
| 1 | Lucite | 97.5 | 87.6 | 132 |
| 2 | Bakelite | 98.4 | 91.6 | 141 |
| 3 | Fe + 0.5% C | 79.6 | 84.6 | 143 |
| 4 | Bi | 0 | 83.6 | 160 |
| 5 | Fe + 0.4% C | 89.6 | 86.6 | 143 |
| 6 | Bi | 0 | 79.8 | 140 |
| 7 | Bi | 41.4 | 88.3 | 154 |
| 8 | Zn | 85.0 | 85.0 | 143 |
| 10 | Sn | 71.5 | 90.0 | 143 |
| 11 | Cu | 72.0 | 80.4 | 125 |

These bullets were fired into a box of sawdust using a +P load of powder, exposing them to pressures in excess of 20,000 pounds per square inch while in the barrel. Examination and weighing of the samples before and after firing revealed that the iron-matrix, copper-matrix and zinc-matrix bullets lost no weight and no material from the end of the composite core that had been exposed to the hot gases in the barrel. Microstructural examination revealed that only the pure bismuth bullet had internal cracks after being fired.

These bullets were also fired at a standard steel plate backstop (0.2 inches thick, hardness of Brinell 327) at an incidence angle of 45 degrees and a distance typical of indoor pistol ranges. None of the bullets damaged the backstop or ricocheted.

MODIFICATIONS AND INCORPORATIONS

Modifications Within the Scope of Invention

While the invention has been described above and below with references to preferred embodiments and specific examples, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure.

Incorporations By Reference

All patent applications, patents and other publications cited herein are incorporated by reference in their entirety as if they were set forth at length.

What is claimed is:

1. A lead free bullet, comprising:

a compacted composite containing a high-density first constituent selected from the group consisting of tungsten, tungsten carbide, ferro-tungsten and mixtures thereof; and a lower density second constituent selected from the group consisting of tin, zinc, aluminum, iron, copper, bismuth and mixtures thereof, wherein the density of said lead free bullet is in excess of 9 grams per cubic centimeter and said lead free bullet deforms or disintegrates at a yield stress of less than about 45,000 psi.

2. The lead free bullet of claim 1 further including a polymer binder.

3. The lead free bullet of claim 2 wherein said polymer binder is selected from the group consisting of acrylics and polystyrenes.

4. The lead free bullet of claim 1 coated with a jacket selected from the group consisting of tin, zinc, copper, brass and plastic.

5. The lead free bullet of claim 4 coated with a brass jacket.

6. The lead free bullet of claim 3 coated with a jacket selected from the group consisting of tin, zinc, copper, brass and plastic.

7. The lead free bullet of claim 6 wherein said jacket is plastic.

8. The lead free bullet of claim 7 wherein said jacket is formed from the same plastic as said polymer binder.

* * * * *